US011708246B2

(12) United States Patent
Myers et al.

(10) Patent No.: US 11,708,246 B2
(45) Date of Patent: Jul. 25, 2023

(54) SWIVEL LUG ASSEMBLY AND SYSTEM FOR LIFTING A LOAD VIA A SPREADER BAR

(71) Applicants: Clayton P. Myers, Webster, TX (US); Timothy I. McCullough, Katy, TX (US)

(72) Inventors: Clayton P. Myers, Webster, TX (US); Timothy I. McCullough, Katy, TX (US)

( * ) Notice: Subject to any disclaimer, the term of this patent is extended or adjusted under 35 U.S.C. 154(b) by 84 days.

(21) Appl. No.: 17/400,315

(22) Filed: Aug. 12, 2021

(65) Prior Publication Data

US 2022/0048741 A1 Feb. 17, 2022

Related U.S. Application Data

(60) Provisional application No. 63/065,080, filed on Aug. 13, 2020.

(51) Int. Cl.
*B66C 1/22* (2006.01)
*B66C 1/66* (2006.01)

(52) U.S. Cl.
CPC . *B66C 1/22* (2013.01); *B66C 1/66* (2013.01)

(58) Field of Classification Search
CPC .. B66C 1/22; B66C 1/66; B66C 1/442; B66C 1/585
USPC ..... 294/81.1
See application file for complete search history.

(56) References Cited

U.S. PATENT DOCUMENTS

| | | | | |
|---|---|---|---|---|
| 4,397,493 | A * | 8/1983 | Khachaturian | B66C 1/12 294/81.1 |
| 4,538,849 | A * | 9/1985 | Khachaturian | B66C 1/12 294/81.1 |
| 5,603,544 | A * | 2/1997 | Bishop | B66C 1/12 294/81.1 |
| 7,222,903 | B2 * | 5/2007 | Tardiff | B66C 1/10 294/74 |
| 8,622,448 | B1 * | 1/2014 | Butterfield, IV | B66C 1/66 294/67.1 |
| 9,469,509 | B1 * | 10/2016 | Myers | B66C 1/10 |
| 10,053,338 | B1 * | 8/2018 | Khachaturian | B66C 1/66 |
| 10,259,687 | B2 * | 4/2019 | Myers | B66C 1/10 |
| 10,577,225 | B1 * | 3/2020 | Khachaturian | B66C 1/66 |
| 10,633,223 | B1 * | 4/2020 | Cain | B66C 1/12 |
| 2009/0072561 | A1 * | 3/2009 | Latham | B66C 1/10 294/81.2 |
| 2019/0002246 | A1 * | 1/2019 | Spronken | E04C 3/005 |

* cited by examiner

*Primary Examiner* — Paul T Chin
(74) *Attorney, Agent, or Firm* — McCutcheon Joseph, PLLC

(57) ABSTRACT

A system for lifting a load via a spreader bar includes a spreader bar and a swivel lug assembly. The swivel lug assembly includes an upper swivel, a lower swivel, and a load pin extending between a pair of load pin holes in the upper swivel and the lower swivel. The upper swivel is pivotable relative to the lower swivel about the load pin. The spreader bar includes two opposing sides each having a height, and spreader bar pin holes in each of the sides. The spreader bar pin holes are located at a midpoint of the height of each of the sides. The load pin is detachably attached to the first swivel lug assembly through the pair of load pin holes in the upper swivel and the lower swivel in order to releasably attach the swivel lug assembly to the spreader bar via two opposing spreader bar pin holes.

18 Claims, 11 Drawing Sheets

SWIVEL LUG ASSEMBLY AND SYSTEM FOR LIFTING A LOAD VIA A SPREADER BAR

CONTINUITY DATA

This application is a non-provisional application that claims priority to U.S. Provisional Application No. 63/065,080, filed on Aug. 13, 2020. The disclosure of the prior application is hereby incorporated by reference herein in its entirety.

FIELD

Embodiments within the scope of this disclosure relate to swivel lug assemblies and systems for lifting a load via a tubular or pipe as a spreader bar. In particular, the embodiments relate to swivel lug assemblies and a systems in which the swivel lug assemblies may be adjustably placed at different locations along the span of the spreader bar, and which are designed to reduce or eliminate a bending moment on the spreader bar during a lifting operation. Without the bending moment, the spreader bar may beneficially be placed in a pure compression state by the swivel lug assemblies, and the structural capacity of the spreader bar is increased. Further, the design of the system allows the swivel lug assemblies to self-align with the fleet/sling angle of the upper and lower riggings, providing the system with greater efficiency. In addition, the design of the swivel lug assemblies allows the swivel lug assemblies to be quickly and easily attached to and disconnected from the spreader bar without material alteration. The systems may incorporate the use of shackles and lifting or load slings with the swivel lug assemblies for lifting a load.

BACKGROUND

Spreader bar systems for lifting tubulars are known. Spreader bar systems allow the force of a single-point lifting system, such as a shackle or hook, to be divided into multiple lifting points, thus avoiding the material stress and safety concerns associated with lifting a heavy load by a single point. Some of those systems utilize an "end cap" system (also known as a compression cap system) for attaching spreader bars to the shackle. In those systems, the spreader bar is fitted between two "end caps," which contain multiple orifices for connecting to both the lifting mechanism above and the load below. However, assembly of the end cap requires precise alignment of the end cap with the spreader bar, and often requires a tubular spreader bar to be physically altered, e.g., through spot welds or attachment holes, which can weaken the spreader bar's tolerance for metallurgical stresses. In addition, the process of determining the correct end cap fitting for use with a given load and span of weight to be lifted can often be time-consuming and prone to error when calculated by workers in the field. This can lead to an increased stress on the equipment and the risk of lift failure. Moreover, the end caps and other fitting devices for attaching to a spreader bar are adapted to fit solely one or only a few corresponding spread bars, limiting the use of the end caps and other fitting devices to only a limited number of lifting jobs of a particular dimension and weight.

Another known system is illustrated in FIGS. 1A to 1C. This system 100 has a pair of tube lugs 110 on opposing ends of a spreader bar 120, as shown in FIG. 1A. As best shown in FIGS. 1B and 1C, each tube lug 110 has an upper lug 112, a lower lug 114, and opposing cheek plates 116 that surround a hole 118 through each of the upper lug 112 and the lower lug 114. FIG. 1C is a front view of the tube lug 110 shown in FIG. 1B. The hole 118 in the upper lug 112 receives a shackle or load sling for attachment to a lift point, and the hole 118 in the lower lug 114 receives a shackle or load sling for attachment to a load to be lifted. The tube lugs 110 may include a support ring 117 to structurally reinforce of the tube lugs 110. The tube lugs 110 include bolt holes 119 for attaching the tube lugs 110 to the spreader bar 120 as shown in FIG. 1A. The tube lugs 110 fit around all the sides of the spreader bar 120 such that the forces from the lifting load and the lift point during a lifting operation are exerted on at least the top and bottom surfaces of the spreader bar 120 along the length of the tube lugs 110. These forces create a bending moment on the spreader bar 120 that structurally strains the spreader bar 120. The stresses on the spreader bar 120 in these types of systems are composed of two elements: compressive stresses and bending stresses, which together are referred to as combined stress. The bending moment is determined by the distance from the centerline of the spreader bar 120 to the point of load application at hole 118 in the tube lugs 110. The load sling, as it connects to hole 118, has a horizontal load component and a vertical load component. The bending moment is calculated by multiplying the distance from the center line of the spreader bar 120 to the center of hole 118. The bending moment greatly increases the combined stress and can greatly reduce the ability of the spreader bar 120 to carry the required load. In systems with this type of design, the length of the spreader bar 120 must be shortened to reduce the bending moment acting thereon. A shorter spreader bar 120 may not be practical to the lifting operation. Another option is to create a visual chart that outlines a diminishing capacity with increasing spans (distance between the lower load points) for an operator to consider. However, the chart may add complexity to the lifting operation.

Moreover, the shackle or load sling attached to the upper lugs 112 via the holes 118 may rotate or pivot about the holes 118 to result in an angle (also known as a fleet angle) between the shackle or load sling and the spreader bar 120 that is less than an optimal minimum angle for keeping a pure compressive force exerted on the spreader bar.

A need therefore exists for a lug assembly and spreader bar system that overcome these problems by avoiding the exertion of a bending moment on the spreader bar during a lifting operation, and maintaining a pure compressive force on the spreader bar. In addition, a need exists for lug assembly and spreader bar system that allows the swivel lug assemblies to self-align with the fleet/sling angle of the upper and lower riggings. A need also exists for a lug assembly that is adjustable in order to accommodate a wide range of dimensions and weights in lifting jobs. A need further exists for a spreader bar system in which the physical method of adjustably fixing the fitting device to the spreader bar is simplified to allow field personnel to more quickly and reliably rig-up lifting systems. Embodiments discussed herein meet these needs.

SUMMARY

The present disclosure discusses swivel lug assemblies and systems in which the swivel lug assemblies may be adjustably placed at different locations along the span of the spreader bar for lifting a load via the spreader bar. The swivel lug assemblies are designed to reduce or eliminate a bending moment on the spreader bar during a lifting operation by applying the load from the riggings along the centerline of the spreader bar. Without the bending moment, the spreader bar may beneficially be placed in a pure compression state by the swivel lug assemblies. Each swivel lug assembly is configured so that the upper swivel of the swivel lug assembly self-aligns to be in 100% alignment with the fleet/sling angle of the top side rigging, and so that the lower swivel of the swivel lug assembly self-aligns to be in 100% alignment with the fleet/sling angle of the lower rigging. The design of the swivel lug assemblies allows the swivel lug assemblies to be quickly and easily attached to and disconnected from the spreader bar without material alteration.

In a first embodiment, a system for lifting a load via a spreader bar comprises a first swivel lug assembly comprising: an upper swivel; a lower swivel; and a load pin extending between a pair of load pin holes in the upper swivel and the lower swivel, wherein the upper swivel is pivotable relative to the lower swivel about the load pin; a spreader bar comprising: two opposing sides each having a height; and a series of spreader bar pin holes in each of the two opposing sides, the series of spreader bar pin holes being located at a midpoint of the height of each of the opposing sides, wherein the load pin is detachably attached to the first swivel lug assembly through the pair of load pin holes in the upper swivel and the lower swivel in order to releasably attach the first swivel lug assembly to a first end portion of the spreader bar via two opposing spreader bar pin holes of the series of spreader bar pin holes.

In an embodiment, the system may further comprise: a second swivel lug assembly comprising: an upper swivel; a lower swivel; and a load pin extending between a pair of load pin holes in the upper swivel and the lower swivel of the second swivel lug assembly, wherein the upper swivel of the second swivel lug assembly is pivotable relative to the lower swivel of the second swivel lug assembly about the load pin, wherein the load pin is detachably attached to the second swivel lug assembly through the pair of load pin holes in the upper swivel of the second swivel lug assembly and the lower swivel of the second swivel lug assembly in order to releasably attach the second swivel lug assembly to a second end portion of the spreader bar via another two opposing spreader bar pin holes of the series of spreader bar pin holes.

In an embodiment, the system may further comprise: an upper shackle comprising one end attachable to the upper swivel of the first swivel lug assembly and another end attachable to a lifting point sling; and a lower shackle comprising one end attachable to the lower swivel of the first swivel lug assembly and another end attachable to a load sling.

In an embodiment, the upper swivel of the first swivel lug assembly comprises a minimum angle indicator, and when the first swivel lug assembly is attached to the first end portion of the spreader bar the minimum angle indicator is configured to show that a fleet angle between the upper swivel and the spreader bar is greater than or at a predetermined minimum effective angle.

In an embodiment, the first swivel lug assembly is configured so that a sling load applied to the first swivel lug assembly when the first swivel lug assembly is attached to the first end portion of the spreader bar is divided into a first vertical force component, a second vertical force component opposite the first vertical force, and a horizontal force component, which are concentrated at the load pin, the first vertical force component and the second vertical force component are equal to each other so as to counteract each other, and the load pin applies the horizontal force component along the midpoint of the height of each of the opposing sides of the spreader bar.

In an embodiment, the system may further comprise: a lifting point sling attachable to the another end of the shackle; and a load sling attachable to the another end of the lower shackle.

In an embodiment, the load pin of the first swivel lug assembly attached to the first end portion of the spreader bar and the load pin of the second swivel lug assembly attached to the second end portion of the spreader bar convert a sling load applied on the first swivel lug assembly and the second swivel lug assembly to a pure compressive force on the spreader bar.

In another embodiment, a swivel lug assembly for attaching to a spreader bar, may comprise: an upper swivel comprising: a first upper swivel side plate; a second upper swivel side plate opposite the first upper swivel plate; an upper lug base plate between the first upper swivel side plate and the second upper swivel side plate; an upper lug cross brace between the first upper swivel side plate and the second upper swivel side plate; an upper lug extending in a direction from the upper lug base plate; a lower swivel comprising: a first lower swivel side plate; a second lower swivel side plate opposite the first lower swivel plate; a lower lug base plate between the first lower swivel side plate and the second lower swivel side plate; a lower lug cross brace between the first lower swivel side plate and the second lower swivel side plate; a lower lug extending in a direction from the lower lug base plate; and a load pin extending between a pair of load pin holes in the upper swivel and the lower swivel, wherein the upper swivel is pivotable relative to the lower swivel about the load pin.

In an embodiment, the load pin is detachably attached to the swivel lug assembly through the pair of load pin holes in the upper swivel and the lower swivel in order to releasably attach the swivel lug assembly to the spreader bar.

In an embodiment, the load pin is configured to absorb a sling load applied to the swivel lug assembly when the swivel lug assembly is attached to the spreader bar.

In an embodiment, the upper swivel and the lower swivel are configured so that the sling load applied to the swivel lug assembly is divided into a first vertical force component, a second vertical force component opposite the first vertical force, and a horizontal force component, which are concentrated at the load pin, the first vertical force component and the second vertical force component are equal to each other so as to counteract each other, and the load pin applies the horizontal force component along a midpoint of a height of the spreader bar.

In an embodiment, the upper swivel comprises a minimum angle indicator, and when the swivel lug assembly is attached to the spreader bar the minimum angle indicator is configured to show that a fleet angle between the upper swivel and the spreader bar is greater than or at a predetermined minimum effective angle.

In an embodiment, the upper lug cross brace passes through a slit in the upper lug.

In an embodiment, the swivel lug assembly further comprises: a bushing located in the pair of load pin holes in the upper swivel and the lower swivel for maintaining a connection between the upper swivel and the lower swivel when the load pin is detached from the swivel lug assembly.

In a further embodiment, a swivel lug assembly for attaching to a spreader bar, may comprise: an upper swivel; a lower swivel; and a load pin extending between a pair of load pin holes in the upper swivel and the lower swivel, wherein the upper swivel is pivotable relative to the lower swivel about the load pin, and wherein the load pin is detachably attached to the swivel lug assembly through the pair of pin holes in the upper swivel and the lower swivel in order to releasably attach the swivel lug to the spreader bar.

In an embodiment, the load pin is configured to absorb a sling load applied to the swivel lug assembly when the swivel lug assembly is attached to the spreader bar.

In an embodiment, the upper swivel and the lower swivel are configured so that the sling load applied to the swivel lug assembly is divided into a first vertical force component, a second vertical force component opposite the first vertical force, and a horizontal force component, which are concentrated at the load pin, the first vertical force component and the second vertical force component are equal to each other so as to counteract each other, and the load pin applies the horizontal force component along a midpoint of a height of the spreader bar.

In an embodiment, the upper swivel comprises a minimum angle indicator, and when the first swivel lug assembly is attached to the spreader bar the minimum angle indicator is configured to show that a fleet angle between the upper swivel and the spreader bar is greater than or at a predetermined minimum effective angle.

In an embodiment, the load pin is detachably attached to the swivel lug assembly through a pair of load pin holes in the upper swivel and the lower swivel in order to releasably attach the swivel lug assembly to the spreader bar.

In an embodiment, the swivel lug assembly may further comprise: a bushing located in the pair of load pin holes in the upper swivel and the lower swivel for maintaining a connection between the upper swivel and the lower swivel when the load pin is detached from the swivel lug assembly.

BRIEF DESCRIPTION OF THE DRAWINGS

In the detailed description of various, example embodiments within the scope of the present disclosure, reference is made to the accompanying drawings, in which.

One or more embodiments are described below with reference to the above-listed figures.

DETAILED DESCRIPTION

Before describing selected, example embodiments of the present disclosure in detail, it is to be understood that the present invention is not limited to the particular embodiments described herein. The disclosure and description herein is illustrative and explanatory of one or more example embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and disclose presently example embodiments to one of skill in the art, but are not intended to be manufacturing level drawings or renditions of final products, and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1A:
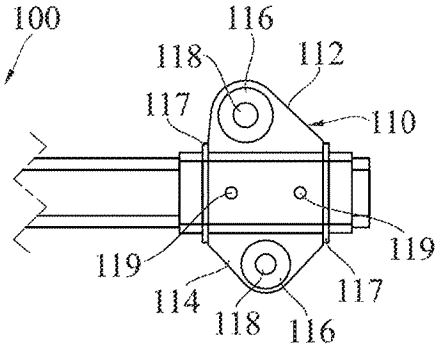
FIG. 1A PRIOR ART
FIGS. 1A to 1C illustrate a conventional system for lifting a load via a spreader bar.
Figure 1C:
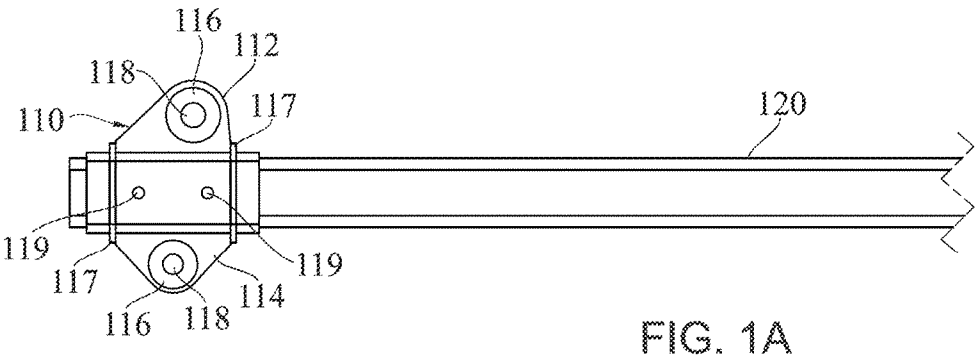
FIG. 1C PRIOR ART
Figure 1C:
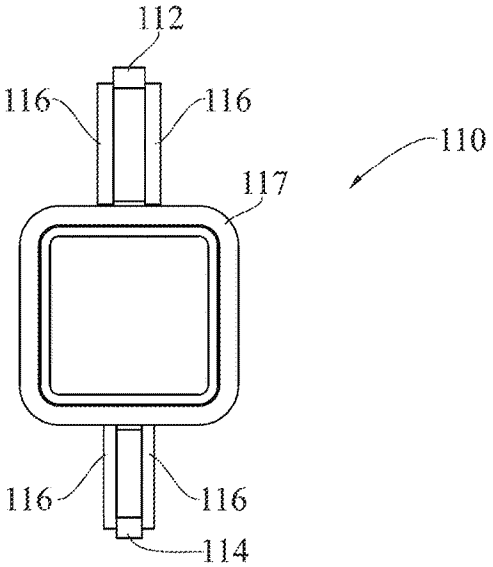
FIG. 1C PRIOR ART
Figure 1B:
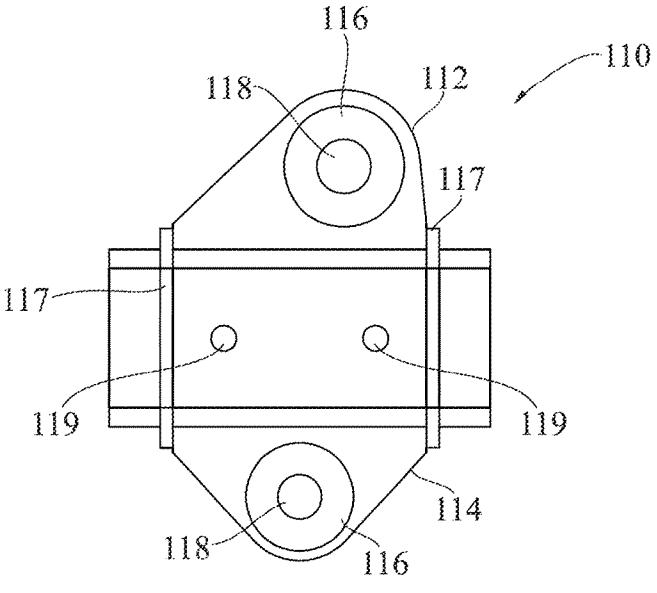
FIG. 1B PRIOR ART
Figure 2:
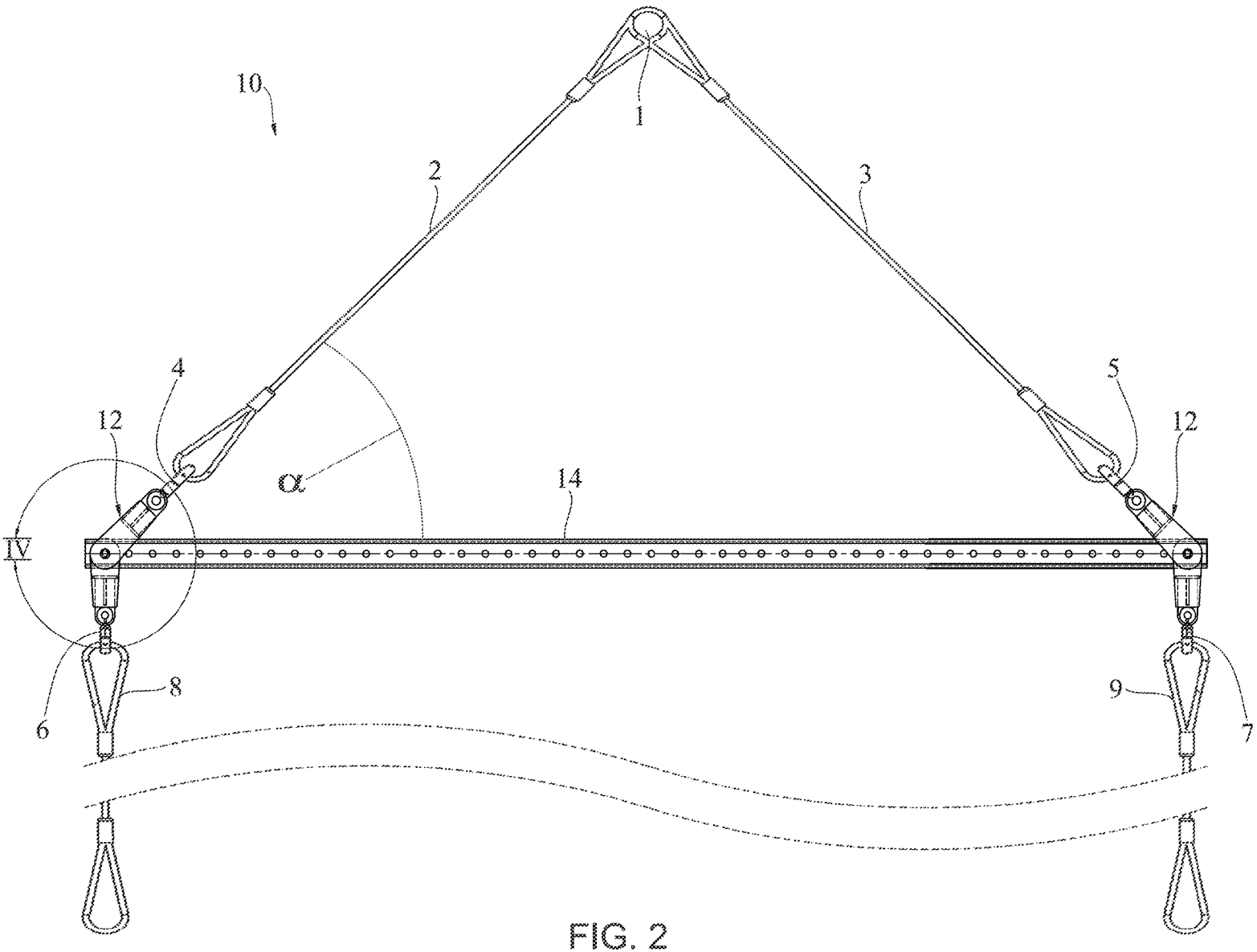
FIG. 2 depicts elements of a system for lifting a load via a spreader bar according to a present embodiment.

FIG. 2 illustrates a system 10 for lifting a load via a spreader bar 14 according to an embodiment. The system 10 includes a swivel lug assembly 12 attached to opposing end portions of the spreader bar 12. The system 10 may further include a lift point 1, lifting point slings 2, 3, upper shackles 4, 5, lower shackles 6, 7, and load slings 8, 9. As shown in FIG. 1, lifting point sling 2 may be connected at one end to the lift point 1 and at the other end to a first end of shackle 4. The second end of shackle 4 may be connected to the upper swivel of one of the swivel lug assemblies 12. Lifting point sling 3 may be connected at one end to the lift point 1 and at the other end to a first end of shackle 5. The second end of shackle 5 may be connected to the upper swivel of the other swivel lug assembly 12. Load sling 8 may be connected at one end to a weight to be lifted (not shown), and at the other end to a first end of shackle 6. The second end of shackle 6 may be connected to the lower swivel of one of the swivel lug assemblies 12. Load sling 9 may be connected at one end to the weight to be lifted, and at the other end to a first end of shackle 7. The second end of shackle 7 may be connected to the lower swivel of the other swivel lug assembly 12. Optimally, the relationship between the lifting point slings 2, 3 and the spreader bar 14 may be defined by a minimum angle (also known as a fleet angle), shown as $\alpha$, so as to keep the compressive force exerted on the spreader bar 14 within a maximum tolerance. In one embodiment, the minimum fleet angle may be 45 degrees. However, the pivoting ability of the upper swivel 20 allows the swivel lug assemblies 12 to accommodate fleet angles less than 45 degrees as needed.

Figure 3A:
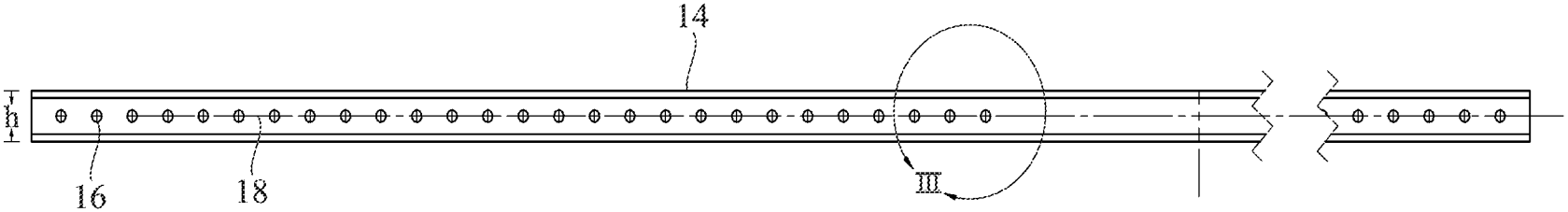
FIGS. 3A to 3C illustrate views of a spreader bar according to an embodiment.
Figure 3C:
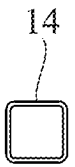
Figure 3B:
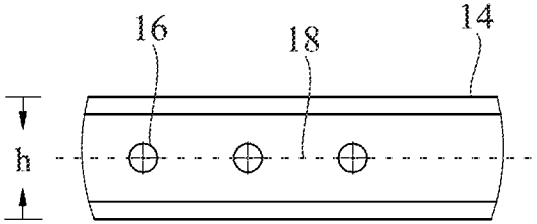

FIGS. 3A to 3C illustrate aspects of the spreader bar 14 according to an embodiment. As shown in FIG. 3A, the spreader bar 14 may include a series of pin holes 16 which extends along the span of the spreader bar 14. The pin holes 16 are included on both opposing sides of the spreader bar 14 to accommodate a load pin 32 (discussed below) of the swivel lug assemblies 12, so that the load pin 32 extends through both sides (i.e., two opposing pin holes 16) of the spreader bar 14. A first series of pin holes 16 may extend from one end of the spreader bar 14, and a second series of pin holes 16 may extend from the other end of the spreader bar 14. It may not be necessary to include pin holes 16 in a central portion of the span of the spreader bar 14, as it is anticipated that the swivel lug assemblies 12 are attached somewhere along the end portions of the spreader bar 14 during a lifting operation. FIG. 3B is a close-up view of section III of the spreader bar 14 in FIG. 3A, and FIG. 3C is a cross-sectional view of the spreader bar 14. In the illustrated embodiment, the cross-sectional shape of the spreader bar is rectangular, so as to have a top surface, a bottom surface, and two opposing sides between the top and bottom surfaces. The spreader bar 14 have alternatively have other polygonal cross-sectional shapes, such as a circle or cylinder, so long as the spreader bar includes two opposing side surfaces having the opposing pin holes 16 for accommodating the load pins 32 of the swivel lug assemblies 12. As shown in FIGS. 3A and 3B, the two opposing sides of the spreader bar 14 each have a height "h". Significantly, the series of spreader bar pin holes 16 are located at a midpoint 18 of the height "h". The significance of the pin holes being located at the midpoint 18 of the height "h" is discussed below.

Figure 5:
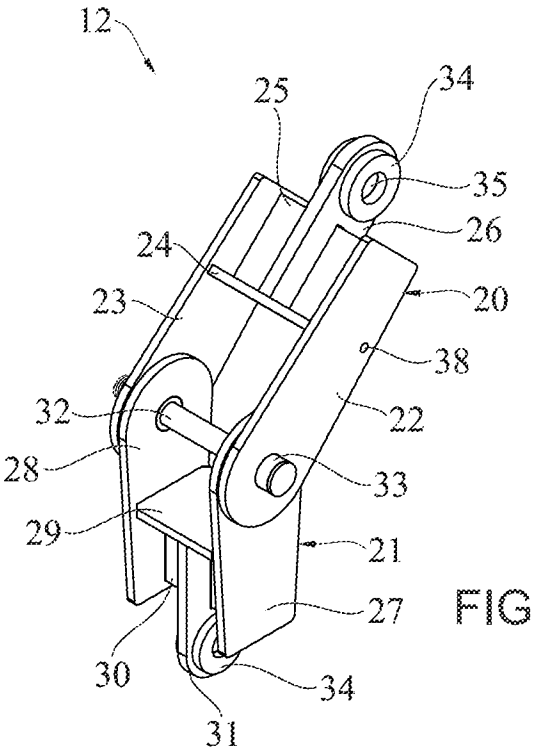
FIG. 5 is a perspective view of the swivel lug assembly according to an embodiment.
Figure 4A:
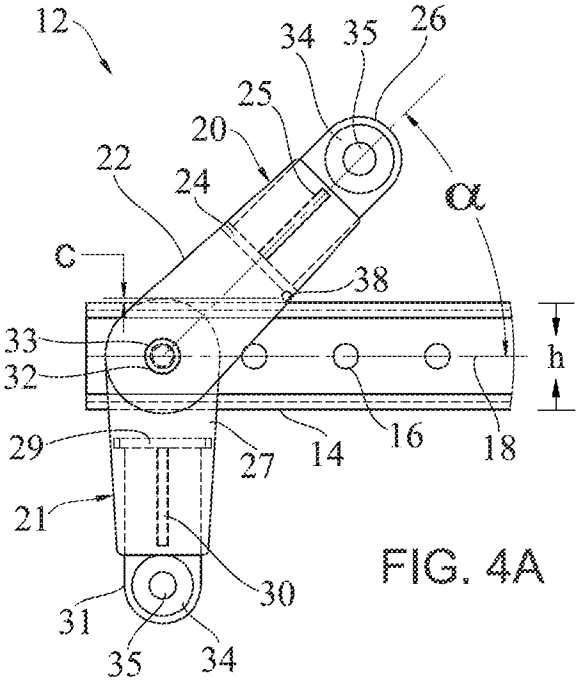
FIG. 4A is a detail view of a portion of FIG. 2, which is a close up view a swivel lug assembly attached to the spreader bar according to an embodiment.

FIG. 4A is a close-up view of a section IV of the system 10 shown in FIG. 2, and illustrates a swivel lug assembly 12 attached via a load pin 32 to an end portion of the spreader bar 14 at a midpoint 18 of the height "h" of the spreader bar 14. FIGS. 4 and 5 show details of the swivel lug assembly 12. The swivel lug assembly 12 is generally composed of an upper swivel 20 and a lower swivel 21. The upper swivel 20 may include a first upper swivel side plate 22 and a second upper swivel side plate 23 opposite the first upper swivel plate 22. An upper lug base plate 24 may be provided between the first upper swivel side plate 22 and the second upper swivel side plate 23, and may connect the first upper swivel side plate 22 and the second upper swivel side plate 23 to each other. An upper lug cross brace 25 also is provided between the first upper swivel side plate 22 and the second upper swivel side plate 23. The upper lug cross brace 25 may also connect the first upper swivel side plate 22 to the second upper swivel side plate 23. An upper lug 26 may extend in a direction from the upper lug base plate 24, and may be attached to the upper lug base plate 24 and/or the upper lug cross brace 25. The upper lug 26 includes a lug hole 35 for attaching an upper shackle 4, 5 or lifting point sling 2, 3 to the upper swivel 20. A cheek plate 34 may be provided on opposite sides of the lug hole 35 to reinforce the strength of the material of the upper lug 26 at the lug hole 35.

As shown in FIG. 4A and FIG. 5, the lower swivel 21 may include a first lower swivel side plate 27 and a second lower swivel side plate 28 opposite the first lower swivel plate 27. An lower lug base plate 29 may be provided between the first lower swivel side plate 27 and the second lower swivel side plate 28, and may connect the first lower swivel side plate 27 and the second lower swivel side plate 28 to each other. A lower lug cross brace 30 also is provided between the first lower swivel side plate 27 and the second lower swivel side plate 28. The lower lug cross brace 30 may also connect the first lower swivel side plate 27 to the second lower swivel side plate 28. An lower lug 31 may extend in a direction from the lower lug base plate 29, and may be attached to the lower lug base plate 29 and/or the lower lug cross brace 30. The lower lug 31 also includes a lug hole 35 for attaching a lower shackle 6, 7 or load sling 8, 9 to the lower swivel 21. A cheek plate 34 may be provided on opposite sides of the lug hole 35 to reinforce the strength of the material of the lower lug 31 at the lug hole 35.

Figure 6C:
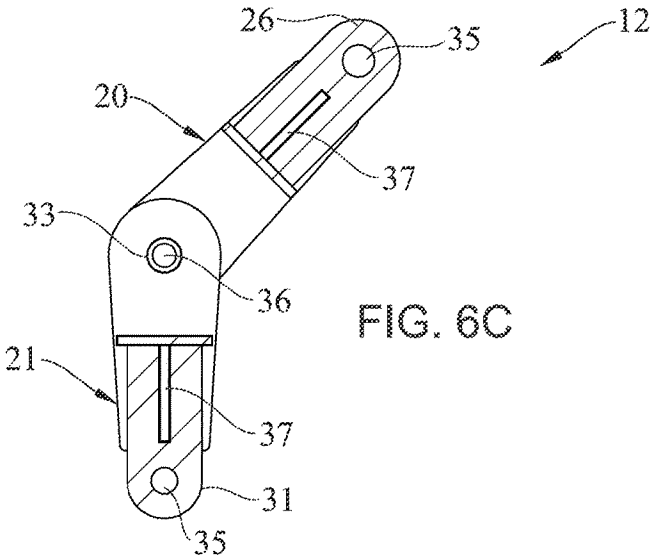
FIGS. 6A to 6D illustrate different views of the swivel lug assembly without a load pin, according to an embodiment.
Figure 6D:
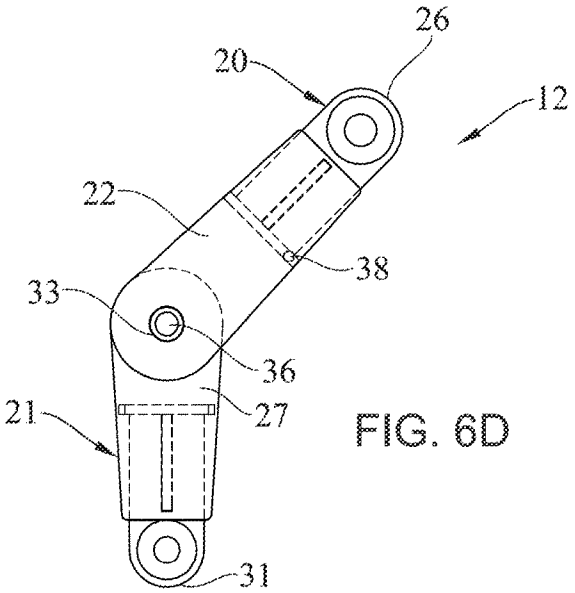
Figure 6B:
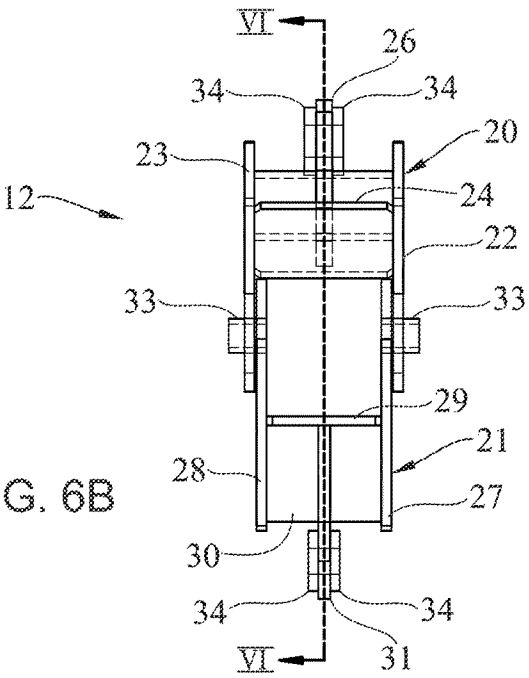
Figure 6A:
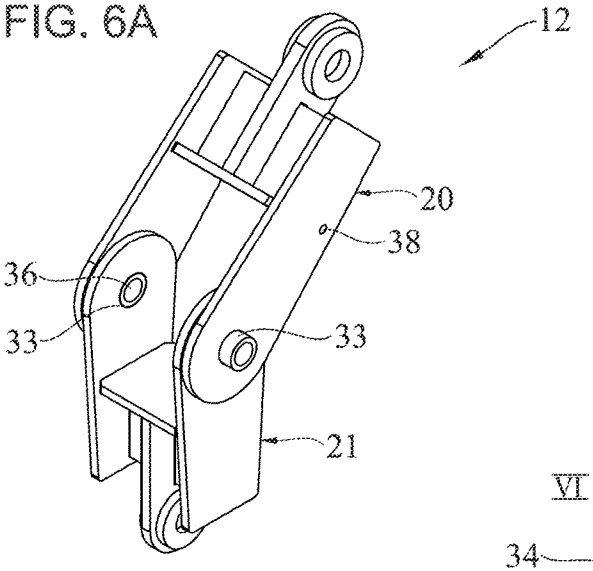

Each of the first upper swivel side plate 22, the second upper swivel side plate 23, the first lower swivel side plate 27, and the second lower swivel side plate 28, includes a load pin hole 36 as best shown in FIGS. 6A and 6C. A bushing 33 may be located in the load pin holes 36 on each side of the swivel lug assembly 12, as shown in FIGS. 4 through 6D. The load pin 32, which is removable, may be inserted through the bushings 33 so as to extend between a pair of the load pin holes 36 and the bushings 33 in the upper swivel 20 and the lower swivel 21 as shown in FIGS. 4 and 5. The upper swivel 20 is pivotable relative to the lower swivel 21 about the load pin 32. In this regard, the angle $\alpha$ (e.g., fleet angle) between the upper swivel 20 and the spreader bar 14 when the swivel lug assembly 12 is attached to the spreader bar 14 as shown in FIG. 4A is variable/adjustable. As such, the upper swivel 20 can self-align to be in 100% alignment with the fleet/sling angle of the lifting point slings 2, 3 and/or upper shackles 4, 5. Similarly, the lower swivel 21 can self-align to be in 100% alignment with the fleet/sling angle of the lower shackles 6, 7 and/or load slings 8, 9. The load pin 32 is detachably attached to the swivel lug assembly 12 through the pair of load pin holes 36 and bushings 33 in the upper swivel 20 and the lower swivel 21 in order to releasably attach the swivel lug assembly 12 to the spreader bar 14. That is, the swivel lug assembly 12 may be attached at various locations along the span of the spreader bar 14 by: (a) withdrawing the load pin 32 from the swivel lug assembly 12; (b) moving the swivel lug assembly 12 to a desired location on the spreader bar at which there is a pair of opposing pin holes 16 on the spreader bar 14; and (c) then reinserting the load pin 32 into a first pair of adjacent load pin holes 36 formed by the upper swivel 20 and the lower swivel 21, the opposing pin holes 16 on the spreader bar 14, and the second pair of adjacent load pin holes 36 in the upper swivel 20 and the lower swivel 21. The swivel lug assemblies 12 can thus be adjustably placed at different locations along the span of the spreader bar 14 to accommodate a wide range of dimensions and weights in different lifting jobs. In addition, this configuration allows the swivel lug assemblies 12 to be quickly, easily and safely attached to and disconnected from the spreader bar 14 without material alteration.

FIGS. 6A to 6D illustrate different views of the swivel lug assembly 12 without the load pin 32, according to an embodiment. FIG. 6A shows the bushings 33 in the load pin holes 36 of the swivel lug assembly 12. FIG. 6B is a front view of the swivel lug assembly 12 shown in FIG. 6A. FIG. 6C is a cross-sectional side view of the swivel lug assembly 12 shown in FIG. 6B along the line VI.

Figures 7, 8A, 8B:
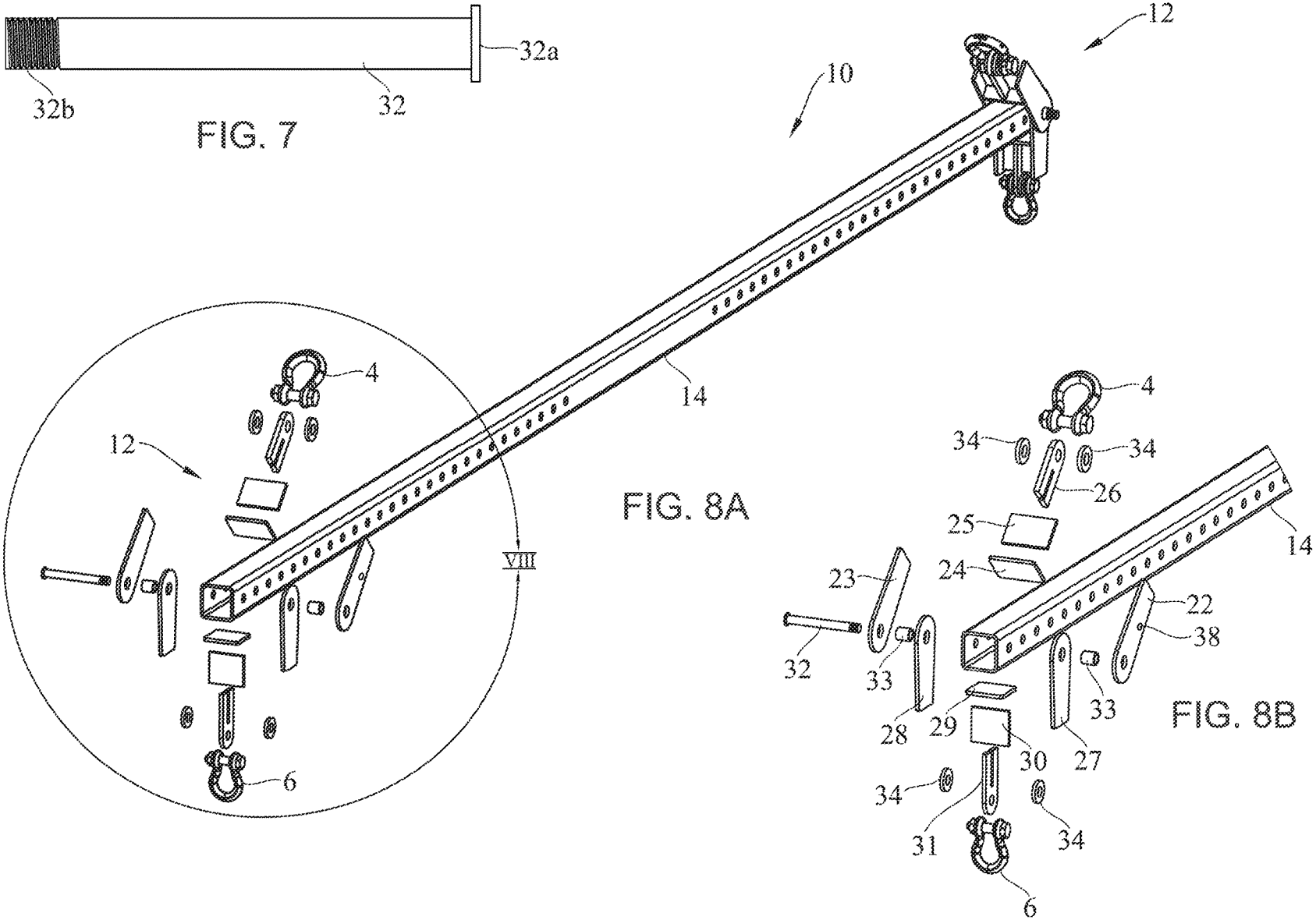
FIG. 7 illustrates a view of the load pin according to an embodiment.
FIG. 8A illustrates an exploded view of the system for lifting a load via a spreader bar according.
FIG. 8B is a detail view of a portion of FIG. 8A.

One embodiment of the load pin 32 is illustrated in FIG. 7, which shows that the load pin 32 includes a head 32*a* at one end thereof for providing a stop against the first upper swivel side plate 22 or the second upper swivel side plate 23. The opposite end of the load pin 32 may include, for example, threads 32*b* for securing a nut to the load pin 32 to prevent the load pin 32 from falling out of the load pin holes 36 in the swivel lug assembly 12. Other devices for securing the load pin 32 in the load pin holes 36 of the swivel lug assembly 12 are encompassed by this disclosure. For instance, as an alternative to the threads 32*b*, the opposite end of the load pin 32 may include a transverse hole (not shown) through which a securing pin may be inserted in a direction orthogonal to the axis of the load pin 32. In other embodiments, a fastener or fasteners may be removably secured to the opposite end of the load pin 32 to prevent the load pin 32 from falling out of the load pin holes 36.

One bushing 33 may be provided in the pair of load pin holes 36 of the adjacent parts of the first upper swivel side plate 22 and the first lower swivel side plate 27, as shown in FIG. 5. Another bushing 33 may be provided in the pair of load pin holes 36 of the adjacent parts of the second upper swivel side plate 23 and the second lower swivel side plate 28. In this manner, the bushings 33 may maintain a connection between the upper swivel 20 and the lower swivel 21 when the load pin 32 is detached from the swivel lug assembly 12.

In an alternative embodiment, the bushing 33 may be a split bushing which can allow the upper swivel 20 to be separated from the lower swivel 21 if needed. That is, a separate bushing 33, or a separate piece of the bushing 33, may be provided in the load pin hole 36 of each of the upper swivel side plate 22, the first lower swivel side plate 27, the second upper swivel side plate 23, and the second lower swivel side plate 28. This split bushing configuration allows the upper swivel 20 to be separated from the lower swivel 21 when the load pin 32 is absent from the swivel lug assembly 12.

Figure 8D:
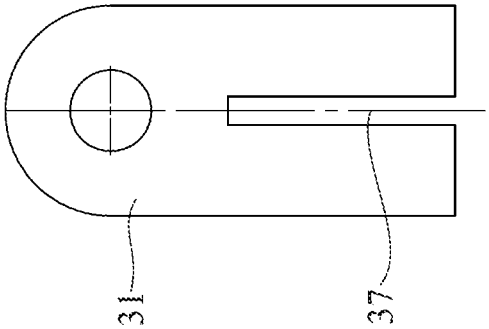
FIGS. 8C and 8D illustrate component parts of the swivel lug assembly.
Figure 8C:
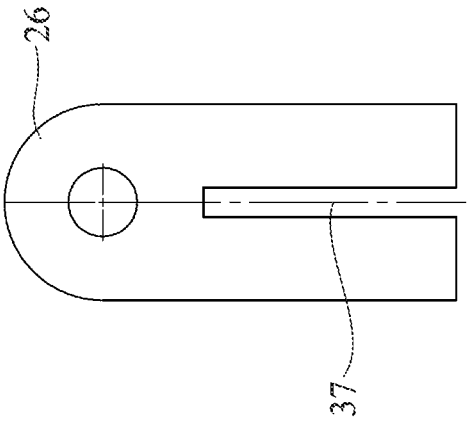

FIG. 6C shows that the upper lug 26 may include a slit 37, and that the upper lug cross brace 25 may pass through the slit 37 in the upper lug 26. Having the upper lug cross brace 25 pass through the slit 37 in the upper lug 26 adds structural strength to the upper swivel 20. Similarly, the lower lug 31 may include a slit 37, and that the lower lug cross brace 30 may pass through the slit 37 in the lower lug 31. A separate side view of the upper lug 26 and slit 37 is shown in FIG. 8C, and a separate side view of the lower lug 31 and slit 37 is shown in FIG. 8D.

FIG. 8A is an exploded view of the system 10 for lifting a load via a spreader bar 14 and two swivel lug assemblies 12. The system includes shackles, and upper shackle 4 and lower shackle 6 are labeled. FIG. 8B is a detail view of a portion of FIG. 8A in section VIII, and shows in exploded view the component parts of the swivel lug assembly 12 discussed above. In an embodiment, the spreader bar 14 may be made of ASTM A992 Grade C steel, and the component parts of the swivel lug assembly 12 may be made of ASTM A572 Grade 50 steel. However, the spreader bar 14 and the component parts of the swivel lug assembly 12 are not limited to these materials, and other materials may be used to form parts of the system 10 without departing from the scope of the present disclosure. For instance, other materials that may be used to form the component parts of the swivel lug assembly 12 and/or the spreader bar 14 include aluminum, stainless steel, A36 and other carbon and alloy based metals, plastic, carbon fiber, and oil or water based formulated materials. The spreader bar 14 may be 32 feet in length according to one embodiment of the system 10, and the system 10 may be able to a load weighing 35 tons. Of course, shorter and longer lengths of the spreader bar 14 are within the scope of this disclosure. In an embodiment, the component parts of the upper swivel 20 may be welded to each other, and the component parts of the lower swivel 21 may be welded to each other.

Referring back to FIG. 4A, the swivel lug assembly 12 may be designed with a built-in minimum angle indicator that indicates when a fleet angle α between the upper swivel 20 of the swivel lug assembly 12 and the spreader bar 14 is less than a predetermined minimum effective angle for two attached swivel lug assemblies 12 to maintain the spreader bar 14 in pure compression during a lifting operation. In one non-limiting embodiment, the predetermined minimum angle may be 45 degrees. In other embodiments, the minimum angle may be less than 45 degrees. In one embodiment, the built-in minimum angle indicator may be a visual angle reference 38 located on the outer surface of the first upper swivel side plate 22 and/or the second upper swivel side plate 23. The visual angle reference 38 may be a dot peen mark; a grind, cut, or machined mark; a painted mark; a decal; and/or any visual reference that can be understood for this specific purpose. The visual angle reference 38 indicates that the upper swivel 20 (and/or lifting point slings 2, 3, and upper shackles 4, 5) has reached the minimum effective angle α when the visual angle reference 38 is flush with, or at the same level as, the upper surface of the spreader bar 14, or when there is a small predetermined clearance "c" (e.g., 0.30 inches) between the visual angle reference 38 and the spreader bar 14. Thus, the visual angle reference 38 serves to indicate when a fleet angle α between the upper swivel 20 of the swivel lug assembly 12 and the spreader bar 14 is at or greater than a minimum effective angle.

In an another embodiment of the built-in minimum angle indicator, FIG. 4A shows that there is a small predetermined clearance "c" (e.g., 0.30 inches) between the upper lug base plate 24 and the spreader bar 14 when the fleet angle α between the upper swivel 20 and the spreader bar 14 is less than a minimum effective angle. If the upper swivel 20 is rotated further downward toward the spreader bar 14 so that the fleet angle α becomes less than the minimum effective angle, the upper lug base plate 24 contacts the top surface of the spreader bar 14 and the clearance "c" becomes zero. Contact between the upper lug base plate 24 and the spreader bar 14 prevents further movement of the upper swivel 20 downward toward the spreader bar 14, and indicates that the fleet angle α has become smaller than the minimum effective angle. Thus, the clearance "c" between the upper lug base plate 24 and the spreader bar 14 serves as a minimum angle indicator that indicates when a fleet angle α between the upper swivel 20 of the swivel lug assembly 12 and the spreader bar 14 is at or greater than a minimum effective angle. Contact between the upper lug base plate 24 and the spreader bar 14 indicates that the minimum fleet angle α has been breached, and that such a smaller angle during a lifting operation will result in a bending moment on the spreader bar 14 as a prying action is being applied at the point of contact.

Figure 4B:
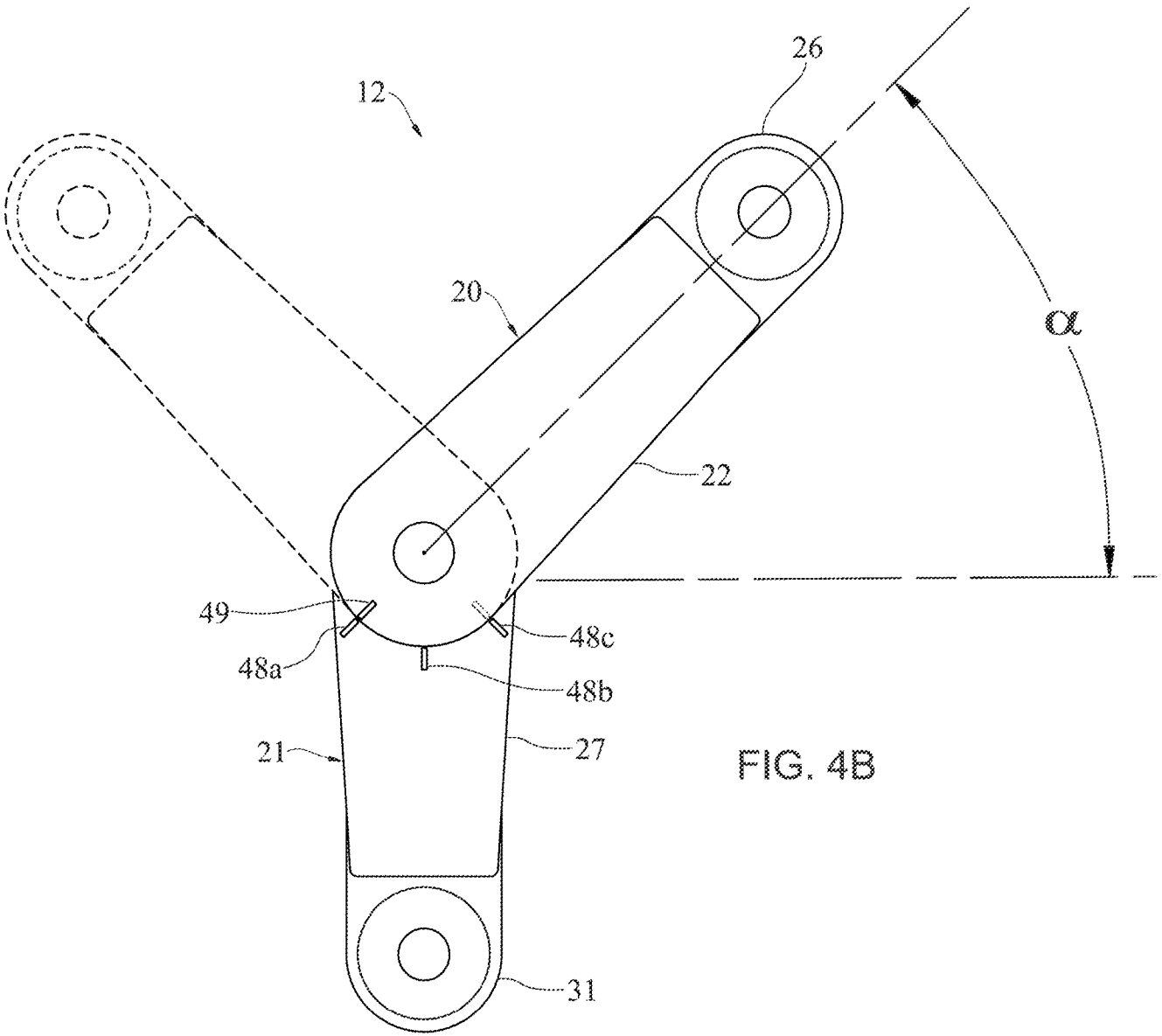
FIG. 4B is a side view of the swivel lug assembly similar to FIG. 4A showing an alternative embodiment of a minimum angle indicator.

A further embodiment of the built-in minimum angle indicator is shown in FIG. 4B. In this embodiment, the first lower swivel side plate 27 of the lower swivel 21 includes a series of lower tick marks 48*a*, 48*b*, 48*c*, which may each be a dot peen mark; a grind, cut, or machined mark; a painted mark; a decal; and/or any visual reference that can be understood for this specific purpose. In the illustrated embodiment, the lower swivel side plate 27 includes a total of three lower tick marks 48*a*, 48*b*, 48*c*, but less or more than three lower tick marks are encompassed by this disclosure. The first upper swivel side plate 22 of the upper swivel 20 includes an upper tick mark 49, which may also be a dot peen mark; a grind, cut, or machined mark; a painted mark; a decal; and/or any visual reference that can be understood for this specific purpose. Rotation of the upper swivel 20 relative to the lower swivel 21 to align the upper tick mark 49 with the first lower tick mark 48*a* serves as a minimum angle indicator to show that the fleet angle α between the upper swivel 20 of the swivel lug assembly 12 and the spreader bar 14 is at the minimum effective angle, e.g., 45 degrees. Further rotation of the upper swivel 20 relative to the lower swivel 21 in the clock-wise direction in FIG. 4B to un-align the upper tick mark 49 and the first lower tick mark 48*a* such that the upper tick mark 49 moves beyond the first lower tick mark 48*a* in the clock-wise direction indicates that the minimum fleet angle α has been breached. Similarly, rotation of the upper swivel 20 relative to the lower swivel 21 in the counter clock-wise direction in FIG. 4B to align the upper tick mark 49 with the third lower tick mark 48*c* may serve as a minimum angle indicator showing that the fleet angle α between the upper swivel 20 of the swivel lug assembly 12 and the spreader bar 14 on the opposite side of the swivel lug assembly 12 is at the minimum effective angle. Alignment of the upper tick mark 49 with second lower tick mark 48*b* may serve to indicate other angles between the upper swivel 20 and the spreader bar 14. Further, the second lower swivel side plate 28 of the lower swivel 21 may also include a series of lower tick marks 48*a*, 48*b*, 48*c*, and the second upper swivel side plate 23 of the upper swivel 20 may also include an upper tick mark 49, so that the minimum angle indicator is provided on both sides of the swivel lug assembly 12.

Figure 9:
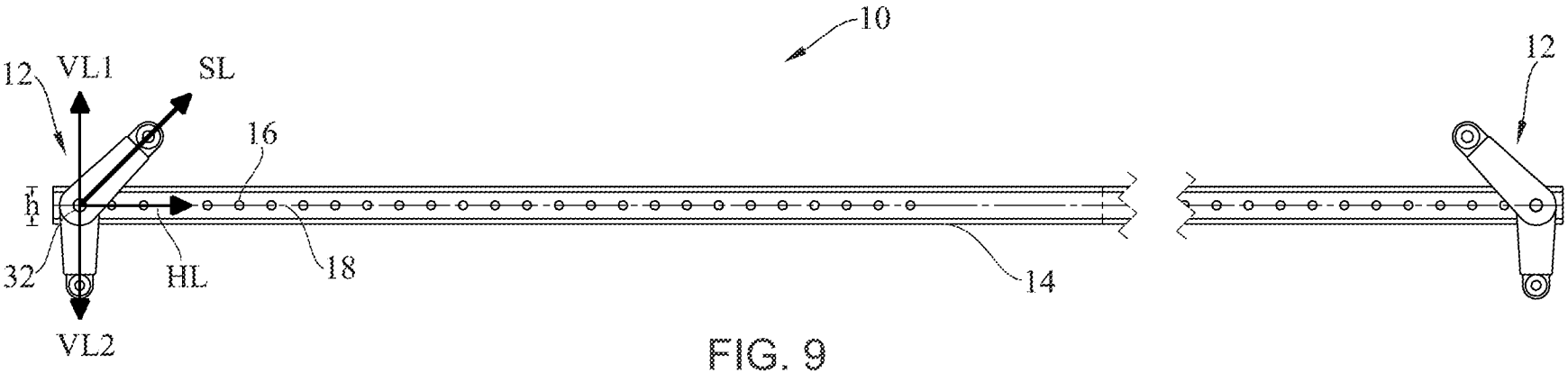
FIG. 9 is a diagram illustrating the distribution of forces resulting from a sling load applied to the system.

FIG. 9 is a diagram illustrating the distribution of forces resulting from a sling load "SL" applied to the system 10. When swivel lug assemblies 12 are attached to the spreader bar 14 during a lifting operation, a sling load "SL" is applied to each swivel lug assembly 12 via, e.g., shackles and slings such as shown in FIG. 2. Because of the configuration of the swivel lug assemblies 12, the sling load "SL" is absorbed by the load pin 32. In this case, the sling load "SL" is divided into a first vertical force component "V1", a second vertical force component "V2" that is opposite to the first vertical force "V1", and a horizontal force component "HL", which are concentrated at the load pin 32. The first vertical force component "V1" and the second vertical force component "V2" are equal to each other so as to counteract each other. Meanwhile, as the load pin 32 is located in opposing pin holes 16 at the midpoint 18 of the height "h" of the spreader bar 14, the load pin 32 applies the horizontal force component "HL" to the spreader bar 14 along the midpoint 18 of the height "h" of the spreader bar 14. Because the horizontal force component "HL" is applied to the spreader bar 14 along the midpoint 18 of the height "h" of the spreader bar 14 (i.e., along or aligned with the spreader bar centerline), a bending moment on the spreader bar during the lifting operation may be reduced or eliminated. As a result, the spreader bar 14 may beneficially be placed in a pure compression state by the swivel lug assemblies 12.

Moreover, the swivel lug assemblies 12 also reduce the load applied to the spreader bar 14. As an example, when the sling load "SL" is 10,000 pounds, the swivel lug assembly 12 (e.g., the load pin 32) divides the 10,000 pound load into a first vertical force component "V1" of 7,071 pounds, a second vertical force component "V2" of 7,071 pounds that is opposite to the first vertical force "V1", and a horizontal force component "HL" of 7,071 pounds. The horizontal force component "HL" of 7,071 pounds is applied to the spreader bar 14 along the midpoint 18 of the height "h" of the spreader bar 14.

Figure 10B:
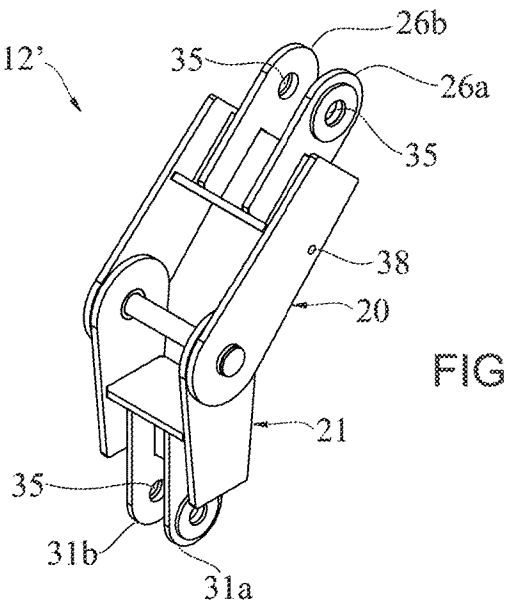
FIGS. 10A to 10E illustrate an alternative embodiment of a swivel lug assembly.
Figure 10D:
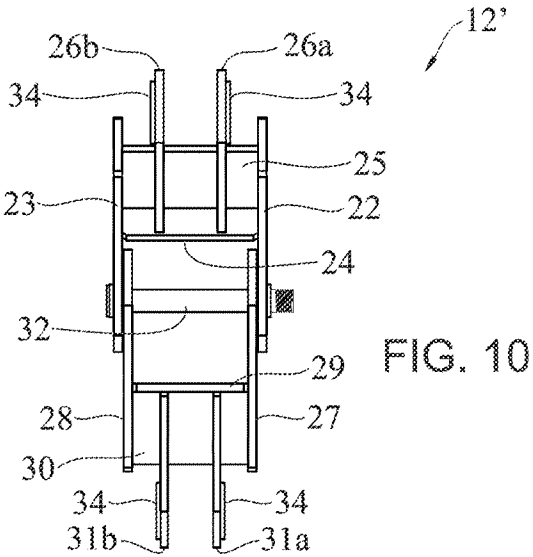
Figure 10A:
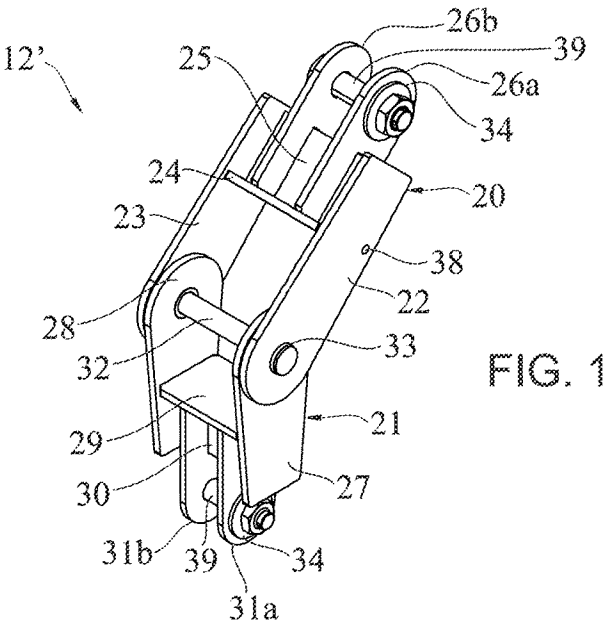
Figure 10C:
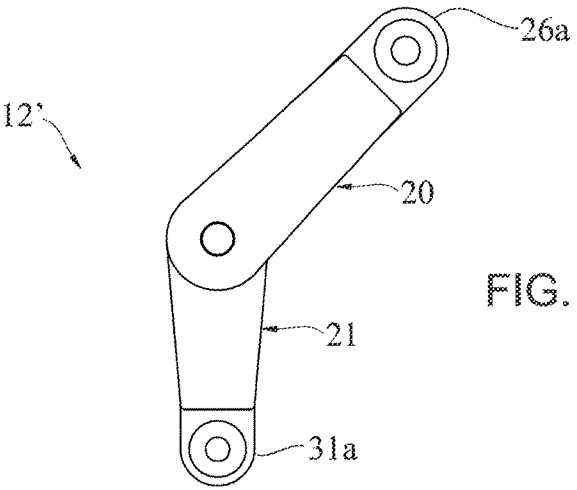
Figure 10E:
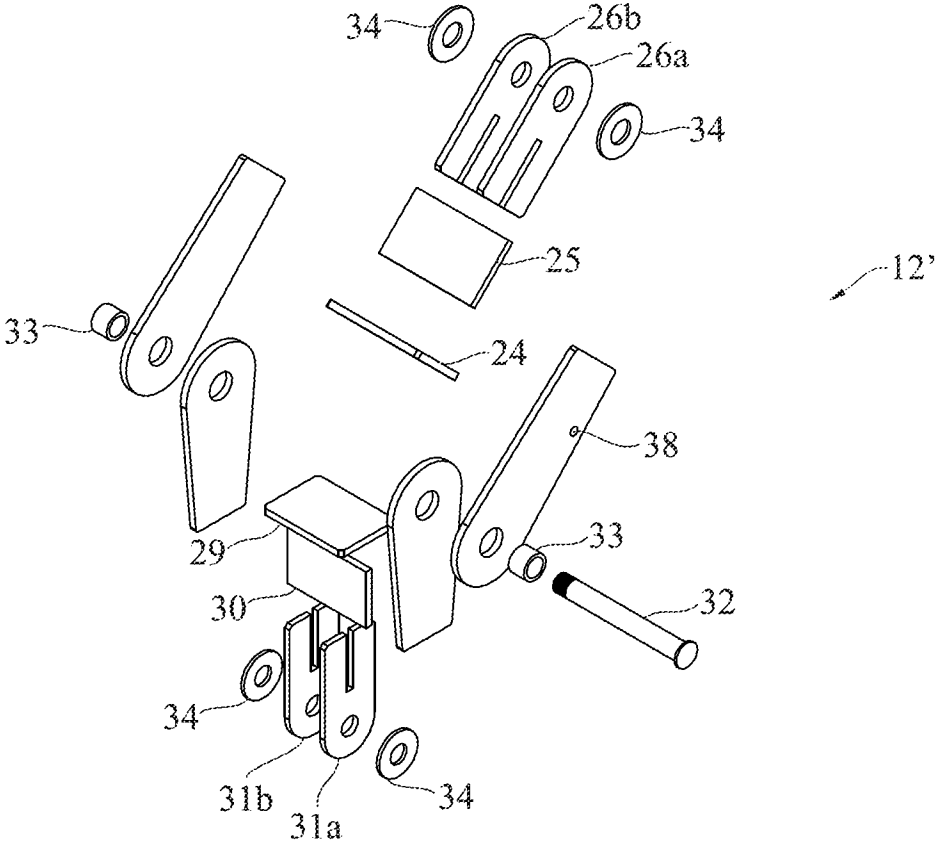

FIGS. 10A to 10E illustrate an alternative embodiment of a swivel lug assembly 12. The alternative embodiment includes a clevis design in which the upper lug of the swivel lug assembly 12' is divided into a first upper lug 26*a* and a second upper lug 26*b* that is spaced at a distance from the first upper lug 26*a*. The first and second upper lugs 26*a*, 26*b* form a clevis. Similarly, the lower lug of the swivel lug assembly 12' is divided into a first lower lug 31*a* and a second lower lug 31*b* that is spaced at a distance from the first lower lug 31*a*, so that the first and second lower lugs 31*a*, 31*b* form a clevis. A lug bolt 39 may be provided through the lug holes 35 (see FIGS. 10A and 10B) of the first and second upper lugs 26*a*, 26*b*. Another lug bolt 39 may be provided through the lug holes 35 of the first and second lower lugs 31*a*, 31*b*. Each lug bolt 39 may include a head at one end thereof, and threads at the opposite end for securing a nut to the lug bolt 39 to prevent the load pin 32 from falling out of the lug holes 35. Of course, other types of fasteners may be removably secured to the opposite end of the lug bolt 39 to prevent the lug bolt 39 from falling out of the lug holes 35. In other respects, the component parts of the swivel lug assembly 12' in this alternative embodiment may be the same as in the previous embodiments discussed above. The clevis design of this alternative embodiment allows a chain or sling to be inserted into the clevis and wrapped around the lug bolt 39. FIG. 10A is a perspective view of the alternative embodiment. FIG. 10B is a perspective view of the alternative embodiment without the lug bolts 39. FIG. 10C is a side view of the swivel lug assembly 12' in FIG. 10B, and FIG. 10D is a front view of the swivel lug assembly 12' in FIG. 10B. FIG. 10E is an exploded view of the swivel lug assembly 12' in FIG. 10B.

Parameters such as height, width, length, thickness, weight, and material of the spreader bar 14, the swivel lug assemblies 12, 12' and their component parts may vary while still remaining within the scope of the present disclosure. In an embodiment, the maximum tolerance for a given weights and span may be pre-calculated and placed in a chart having weights and spans corresponding to different locations of the swivel lug assemblies 12, 12' along the spreader bar 14, for field workers to quickly and reliably select an embodiment of the present invention having parameters which tolerate the lift stresses of a given lifting job.

Figures 11A, 11B, 11C:
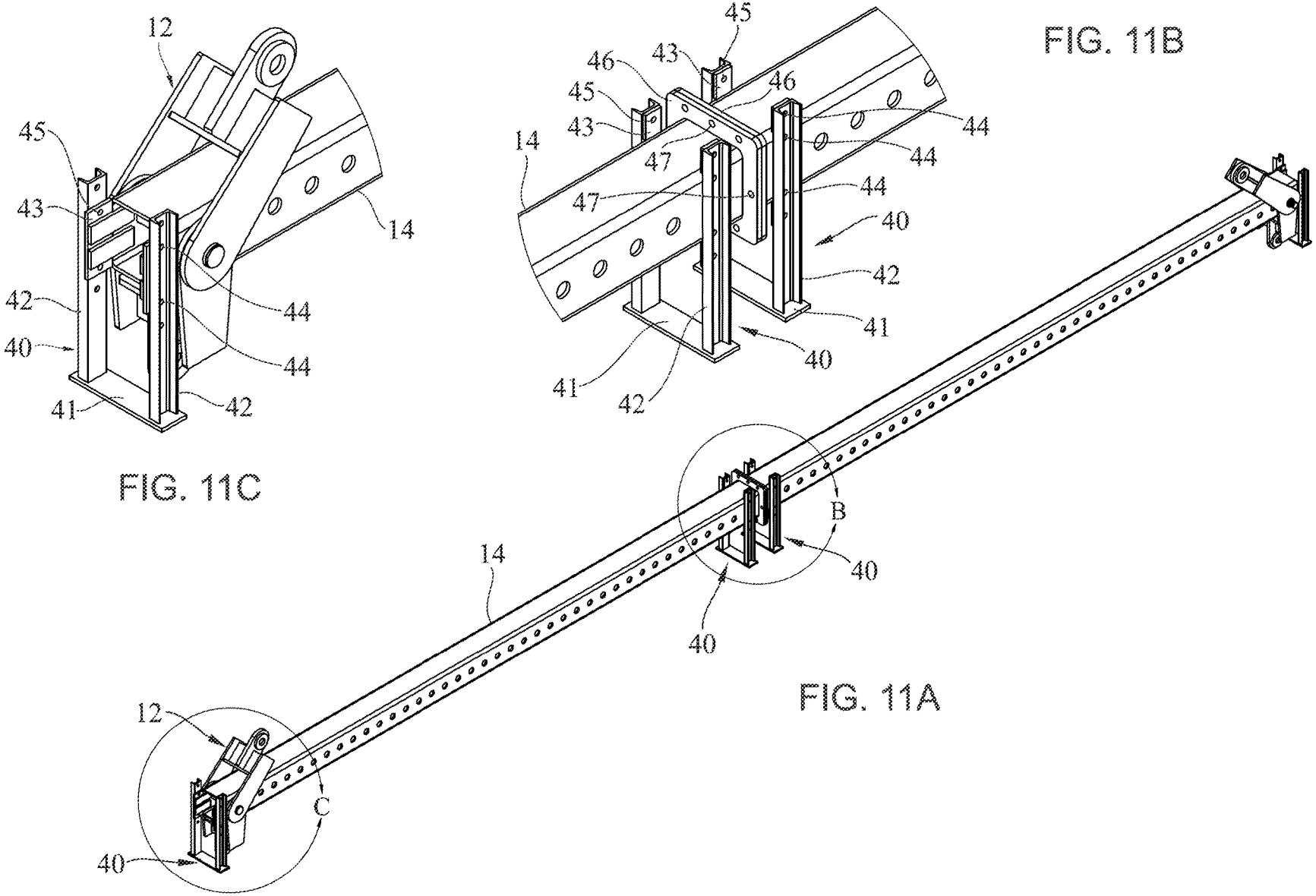
FIGS. 11A to 11C illustrate a further embodiment of the system for lifting a load via the spreader bar.

FIGS. 11A to 11C illustrate a further embodiment of the system 10 for lifting a load via the spreader bar 14. FIG. 11A shows that the spreader bar 14 may include a foot/leg assembly 40. The foot/leg assembly 40 is shown with further detail in FIGS. 11B and 11C, which are close-up views of sections "B" and "C", respectively, in FIG. 11A. FIG. 11B shows the foot/leg assembly 40 at a position on the spreader bar 14 between the two ends of the spreader bar 14 having the swivel lug assemblies 12. Each foot/leg assembly 40 may be formed by two opposing legs 42 attached at to a foot 41, as shown in FIGS. 11A to 11C. The legs 42 may each have a c-shape cross-sectional profile for added strength. The foot 41 may be a baseplate configured to rest on a flat surface. Each leg 42, at one end thereof, may extend vertically from the foot 41, and may be welded to the foot 41. The opposite end of each leg 42 attaches to the spreader bar 14. For instance, the spreader bar 14 may include welded tabs 43 to which the opposite end of the leg 42 is bolted, as shown in FIGS. 11B and 11C. That is, each leg 42 may include bolt holes 44 that cooperate with corresponding bolt holes 45 in the tabs 43 to provide a connection via a bolt (not shown). The welded tabs 43 at the end of the spreader bar 14 proximate the swivel lug assembly 12 may protrude horizontally so as to minimize interference with pivoting movement of the upper swivel 20 and the lower swivel 21. On the other hand, the welded tabs 43 that are located on the spreader bar 14 at a location relatively far from the swivel lug assembly 12 may extend vertically. This is so that the opposite end of the spreader bar 14 may include a flanged connection half 46 having bolt holes 47 for connection to a second flanged connection half 46, via bolts (not shown) at the end of a second spreader bar 14, as shown in FIG. 11A. This two-spreader bar system allows for a relatively long spreader bar 14 to be disassembled into halves for easier transportation and/or storage. The foot/leg assembly 40 may be beneficial for easier and safer set-up of the system 10, as the lifting point slings 2, 3, upper shackles 4, 5, lower shackles 6, 7, and load slings 8, 9 (see FIG. 2) may be attached to the swivel lug assemblies 12 while the spreader bar 14 stands on the foot/leg assembly 40. The foot/leg assembly 40 may also provide for easier storage of the system 10, wherein the system 10 may be stored standing on the foot/leg assembly 40.

While various embodiments usable within the scope of the present disclosure have been described with emphasis, it should be understood that within the scope of the appended claims, the present invention may be practiced other than as specifically described herein.

What is claimed is:

1. A system for lifting a load via a spreader bar, the system comprising:

a first swivel lug assembly comprising:

an upper swivel including an upper lug base plate and a minimum angle indicator;

a lower swivel; and a load pin extending between a pair of load pin holes in the upper swivel and the lower swivel, wherein the upper swivel is pivotable relative to the lower swivel about the load pin;

a spreader bar comprising:

two opposing sides each having a height; and a series of spreader bar pin holes in each of the two opposing sides, the series of spreader bar pin holes being located at a midpoint of the height of each of the opposing sides, wherein the load pin is detachably attached to the first swivel lug assembly through the pair of load pin holes in the upper swivel and the lower swivel in order to releasably attach the first swivel lug assembly to a first end portion of the spreader bar via two opposing spreader bar pin holes of the series of spreader bar pin holes, and wherein when the first swivel lug assembly is attached to the first end portion of the spreader bar the minimum angle indicator is configured to show a predetermined clearance between the upper lug base plate and the spreader bar indicating that a fleet angle between the upper swivel and the spreader bar is at or greater than a predetermined minimum effective angle.

2. The system of claim 1, further comprising:

a second swivel lug assembly comprising:

an upper swivel;

a lower swivel; and a load pin extending between a pair of load pin holes in the upper swivel and the lower swivel of the second swivel lug assembly, wherein the upper swivel of the second swivel lug assembly is pivotable relative to the lower swivel of the second swivel lug assembly about the load pin, wherein the load pin is detachably attached to the second swivel lug assembly through the pair of load pin holes in the upper swivel of the second swivel lug assembly and the lower swivel of the second swivel lug assembly in order to releasably attach the second swivel lug assembly to a second end portion of the spreader bar via another two opposing spreader bar pin holes of the series of spreader bar pin holes.

3. The system of claim 2, wherein the load pin of the first swivel lug assembly attached to the first end portion of the spreader bar and the load pin of the second swivel lug assembly attached to the second end portion of the spreader bar convert a sling load applied on the first swivel lug assembly and the second swivel lug assembly to a pure compressive force on the spreader bar.

4. The system of claim 1, further comprising:

an upper shackle comprising one end attachable to the upper swivel of the first swivel lug assembly and another end attachable to a lifting point sling; and a lower shackle comprising one end attachable to the lower swivel of the first swivel lug assembly and another end attachable to a load sling.

5. The system of claim 4, further comprising:

a lifting point sling attachable to the another end of the shackle; and a load sling attachable to the another end of the lower shackle.

6. The system of claim 1, wherein the first swivel lug assembly is configured so that a sling load applied to the first swivel lug assembly when the first swivel lug assembly is attached to the first end portion of the spreader bar is divided into a first vertical force component, a second vertical force component opposite the first vertical force, and a horizontal force component, which are concentrated at the load pin, the first vertical force component and the second vertical force component are equal to each other so as to counteract each other, and the load pin applies the horizontal force component along the midpoint of the height of each of the opposing sides of the spreader bar.

7. A swivel lug assembly for attaching to a spreader bar, the swivel lug assembly comprising:

an upper swivel comprising:

a first upper swivel side plate;

a second upper swivel side plate opposite the first upper swivel plate;

an upper lug base plate between the first upper swivel side plate and the second upper swivel side plate;

an upper lug cross brace between the first upper swivel side plate and the second upper swivel side plate;

an upper lug extending in a direction from the upper lug base plate;

a lower swivel comprising:

a first lower swivel side plate;

a second lower swivel side plate opposite the first lower swivel plate;

a lower lug base plate between the first lower swivel side plate and the second lower swivel side plate;

a lower lug cross brace between the first lower swivel side plate and the second lower swivel side plate;

a lower lug extending in a direction from the lower lug base plate; and a load pin extending between a pair of load pin holes in the upper swivel and the lower swivel, wherein the upper swivel is pivotable relative to the lower swivel about the load pin.

8. The swivel lug assembly according to claim 7, wherein the load pin is detachably attached to the swivel lug assembly through the pair of load pin holes in the upper swivel and the lower swivel in order to releasably attach the swivel lug assembly to the spreader bar.

9. The swivel lug assembly according to claim 8, wherein the load pin is configured to absorb a sling load applied to the swivel lug assembly when the swivel lug assembly is attached to the spreader bar.

10. The swivel lug assembly according to claim 9, wherein the upper swivel and the lower swivel are configured so that the sling load applied to the swivel lug assembly is divided into a first vertical force component, a second vertical force component opposite the first vertical force, and a horizontal force component, which are concentrated at the load pin, the first vertical force component and the second vertical force component are equal to each other so as to counteract each other, and the load pin applies the horizontal force component along a midpoint of a height of the spreader bar.

11. The swivel lug assembly according to claim 8, the upper swivel comprises a minimum angle indicator, and when the swivel lug assembly is attached to the spreader bar the minimum angle indicator is configured to show that a fleet angle between the upper swivel and the spreader bar is greater than or at a predetermined minimum effective angle.

12. The swivel lug assembly according to claim 8, further comprising:

a bushing located in the pair of load pin holes in the upper swivel and the lower swivel for maintaining a connection between the upper swivel and the lower swivel when the load pin is detached from the swivel lug assembly.

13. The swivel lug assembly according to claim 7, wherein the upper lug cross brace passes through a slit in the upper lug.

14. A swivel lug assembly for attaching to a spreader bar, the swivel lug assembly comprising:

an upper swivel including an upper lug base plate and a minimum angle indicator;

a lower swivel; and a load pin extending between a pair of load pin holes in the upper swivel and the lower swivel, wherein the upper swivel is pivotable relative to the lower swivel about the load pin, wherein the load pin is detachably attached to the swivel lug assembly through the pair of pin holes in the upper swivel and the lower swivel in order to releasably attach the swivel lug assembly to the spreader bar, and wherein when the swivel lug assembly is attached to the spreader bar the minimum angle indicator is configured to show a predetermined clearance between the upper lug base plate and the spreader bar indicating that a fleet angle between the upper swivel and the spreader bar is at or greater than a predetermined minimum effective angle.

15. The swivel lug assembly according to claim 14, wherein the load pin is configured to absorb a sling load applied to the swivel lug assembly when the swivel lug assembly is attached to the spreader bar.

16. The swivel lug assembly according to claim 14, wherein the upper swivel and the lower swivel are configured so that the sling load applied to the swivel lug assembly is divided into a first vertical force component, a second vertical force component opposite the first vertical force, and a horizontal force component, which are concentrated at the load pin, the first vertical force component and the second vertical force component are equal to each other so as to counteract each other, and the load pin applies the horizontal force component along a midpoint of a height of the spreader bar.

17. The swivel lug assembly according to claim 14, wherein the load pin is detachably attached to the swivel lug assembly through a pair of load pin holes in the upper swivel and the lower swivel in order to releasably attach the swivel lug assembly to the spreader bar.

18. The swivel lug assembly according to claim 14, further comprising:

a bushing located in the pair of load pin holes in the upper swivel and the lower swivel for maintaining a connection between the upper swivel and the lower swivel when the load pin is detached from the swivel lug assembly.

* * * * *